US010602262B2

(12) United States Patent
Wu

(10) Patent No.: US 10,602,262 B2
(45) Date of Patent: Mar. 24, 2020

(54) SPEAKER DEVICE

(71) Applicant: Chicony Electronics Co., Ltd., New Taipei (TW)

(72) Inventor: Tsun-Hsin Wu, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 16/049,830

(22) Filed: Jul. 31, 2018

(65) Prior Publication Data

US 2019/0379968 A1 Dec. 12, 2019

(30) Foreign Application Priority Data

Jun. 11, 2018 (TW) ..... 107120067 A

(51) Int. Cl.
*H04R 1/02* (2006.01)
*H04R 1/34* (2006.01)

(52) U.S. Cl.
CPC ..... *H04R 1/345* (2013.01); *H04R 1/025* (2013.01)

(58) Field of Classification Search
CPC ..... H04R 1/025; H04R 1/345
See application file for complete search history.

(56) References Cited

U.S. PATENT DOCUMENTS

| | | | | |
|---|---|---|---|---|
| 5,615,176 | A | 3/1997 | LaCarrubba | |
| 9,843,851 | B2 * | 12/2017 | Chamberlin | H04R 1/028 |
| 10,129,636 | B2 * | 11/2018 | Kim | H04R 1/2803 |
| 10,136,204 | B1 * | 11/2018 | Poole | H04R 1/02 |
| 10,200,781 | B2 * | 2/2019 | Yoo | H04R 1/026 |

FOREIGN PATENT DOCUMENTS

| | | |
|---|---|---|
| CN | 207070301 U | 3/2018 |
| TW | 201640912 A | 11/2016 |

* cited by examiner

*Primary Examiner* — Brian Ensey
(74) *Attorney, Agent, or Firm* — CKC & Partners Co., LLC

(57) ABSTRACT

A speaker device includes a housing, an engagement structure, a sound guide structure, and a speaker unit. The housing has an accommodating space. The engagement structure is disposed on the housing. The sound guide structure is detachably engaged with the engagement structure. The speaker unit is located in the accommodating space and configured to sound towards the sound guide structure.

13 Claims, 10 Drawing Sheets

100A

200

SPEAKER DEVICE

CROSS-REFERENCE TO RELATED APPLICATION

This application claims priority to Taiwan Application Serial Number 107120067, filed Jun. 11, 2018, which is herein incorporated by reference.

BACKGROUND

Technical Field

The present disclosure relates to a speaker device, and more particularly, to a speaker device including a removable sound guide structure.

Description of Related Art

In the case of a traditional speaker device, a configuration that turns the sound direction of the speaker unit toward the user is adopted, such that the sound is directed toward the user and the sound loss rate is low. However, the disadvantage is that the sound box is behind the speaker unit, which occupies a large area at the bottom.

Another traditional speaker device is designed with a configuration that the speaker unit is placed upright (i.e. the sound direction faces upward or downward), so the bottom area can be smaller than the previous traditional speaker device. The speaker unit of this kind of traditional speaker device is not directly oriented toward the user and usually with a non-directional sound field fixed at 360 degrees, so it is often positioned as the center of a multi-person environment or indoor space (such as a conference room or the center of a living room).

However, the sound fields of the two kinds of traditional speaker devices are fixed and cannot be adjusted. Accordingly, how to provide a speaker device to solve the aforementioned problems becomes an important issue to be solved by those in the industry.

SUMMARY

An aspect of the disclosure is to provide a speaker device which can produce different sound fields according to requirements.

According to an embodiment of the disclosure, a speaker device includes a housing, an engagement structure, a sound guide structure, and a speaker unit. The housing has an accommodating space. The engagement structure is disposed on the housing. The sound guide structure is detachably engaged with the engagement structure. The speaker unit is located in the accommodating space and configured to sound towards the sound guide structure.

In an embodiment of the disclosure, the sound guide structure is one of a unidirectional sound guide plate and a multi-directional sound guide plate.

In an embodiment of the disclosure, the housing has an assembly opening in spatial communication with the accommodating space. The engagement structure is disposed in the accommodating space and adjacent to the assembly opening. The sound guide structure covers the assembly opening.

In an embodiment of the disclosure, the engagement structure includes a first latch portion and a supporting portion. The supporting portion is far away from the assembly opening than the first latch portion. The sound guide structure has a second latch portion. The second latch portion is located at an outer edge of the sound guide structure and rotatably retained between the first latch portion and the supporting portion.

In an embodiment of the disclosure, the second latch portion has a notch configured to allow the first latch portion to pass through.

In an embodiment of the disclosure, the sound guide structure further has a stopping portion. The stopping portion is connected to the second latch portion and configured to abut against the first latch portion.

In an embodiment of the disclosure, the housing has an inner surface. The engagement structure is disposed on the inner surface and has a sliding chute. The sound guide structure has a sliding block slidably engaged with the sliding chute.

In an embodiment of the disclosure, the sound guide structure includes a plurality of sound guide substructures. The sound guide substructures are capable of being separated from each other and individually engaged with the engagement structure.

In an embodiment of the disclosure, the housing has an inner surface. The engagement structure is disposed on the inner surface and has a plurality of sliding chutes. Each of the sound guide substructures has a sliding block. The sliding blocks are slidably engaged with the sliding chutes, respectively.

In an embodiment of the disclosure, the sliding chutes are substantially arranged in a radial manner.

In an embodiment of the disclosure, the housing includes a first part and a second part. The speaker unit is disposed on the first part. The second part is rotatably engaged with the first part and forms the accommodating space with the first part. The engagement structure and the sound guide structure are disposed on the second part.

In an embodiment of the disclosure, the housing has a sound outlet. The speaker device further includes a mesh hood. The mesh hood is detachably engaged with the housing and covers the sound outlet.

In an embodiment of the disclosure, the sound guide structure is a unidirectional sound guide plate and has an arc surface. The arc surface has two ends opposite to each other and respectively adjacent to the engagement structure and the speaker unit.

In an embodiment of the disclosure, the sound guide structure is a multi-directional sound guide plate and has a conical arc surface. The conical arc surface has a vertex. The vertex is a portion of the sound guide structure closest to the speaker unit.

Accordingly, in the speaker device of the present disclosure, the speaker unit is placed up right, so the bottom area of the housing can be smaller than traditional speaker devices. In addition, the sound guide structure adopted in the present disclosure can be one of the unidirectional sound guide plate and a multi-directional sound guide plate, and can be detachably engaged with the engagement structure disposed on the housing. As a result, a user can replace different sound guide structures according to requirements to produce sounds with different sound fields.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1A:
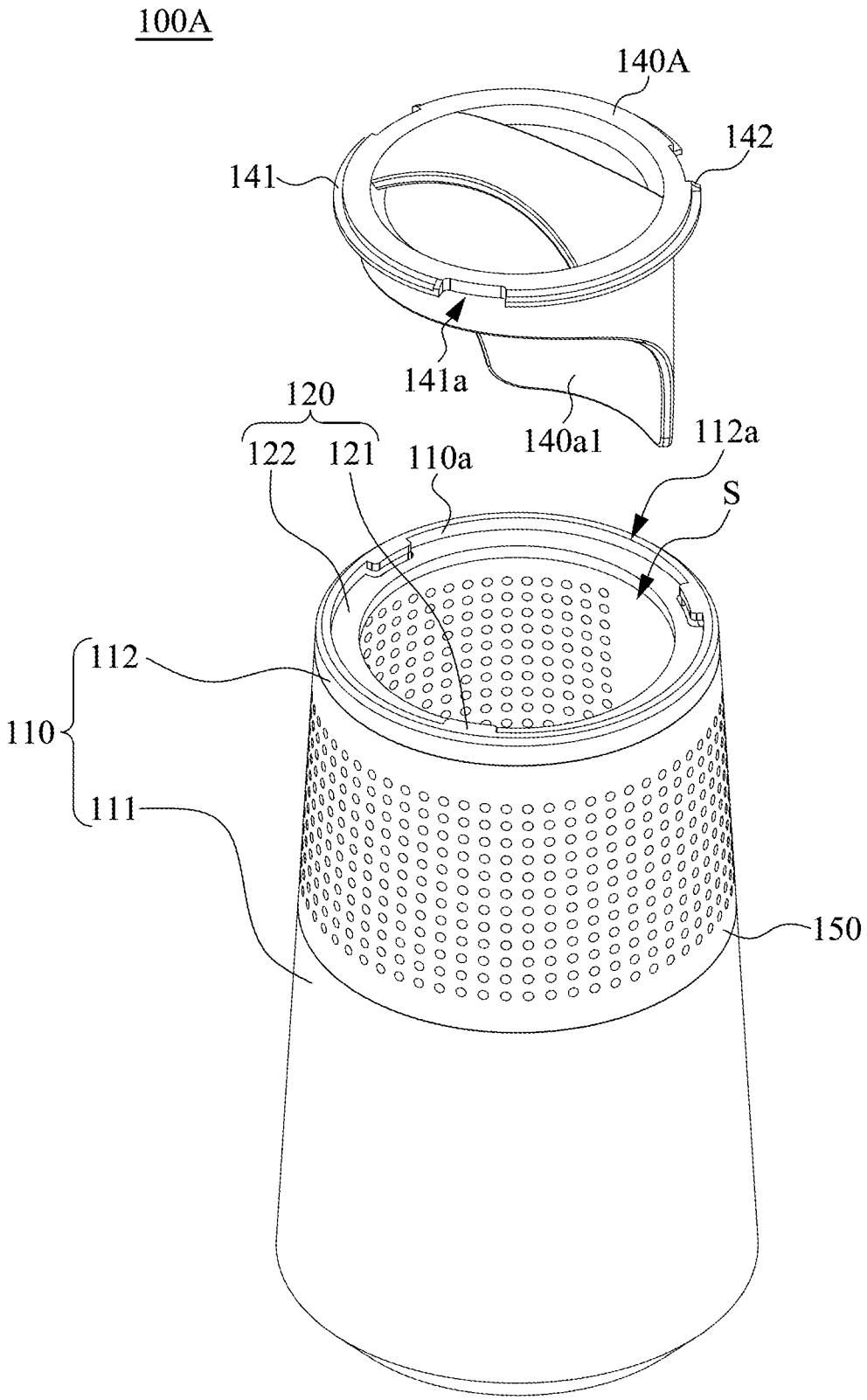
FIG. 1A is a perspective view of a speaker device according to some embodiments of the disclosure, in which a housing is separated from a sound guide structure.

Reference will now be made in detail to the present embodiments of the disclosure, examples of which are illustrated in the accompanying drawings. Wherever possible, the same reference numbers are used in the drawings and the description to refer to the same or like parts. However, specific structural and functional details disclosed herein are merely representative for purposes of describing example embodiments, and thus may be embodied in many alternate forms and should not be construed as limited to only example embodiments set forth herein. Therefore, it should be understood that there is no intent to limit example embodiments to the particular forms disclosed, but on the contrary, example embodiments are to cover all modifications, equivalents, and alternatives falling within the scope of the disclosure.

Figure 1B:
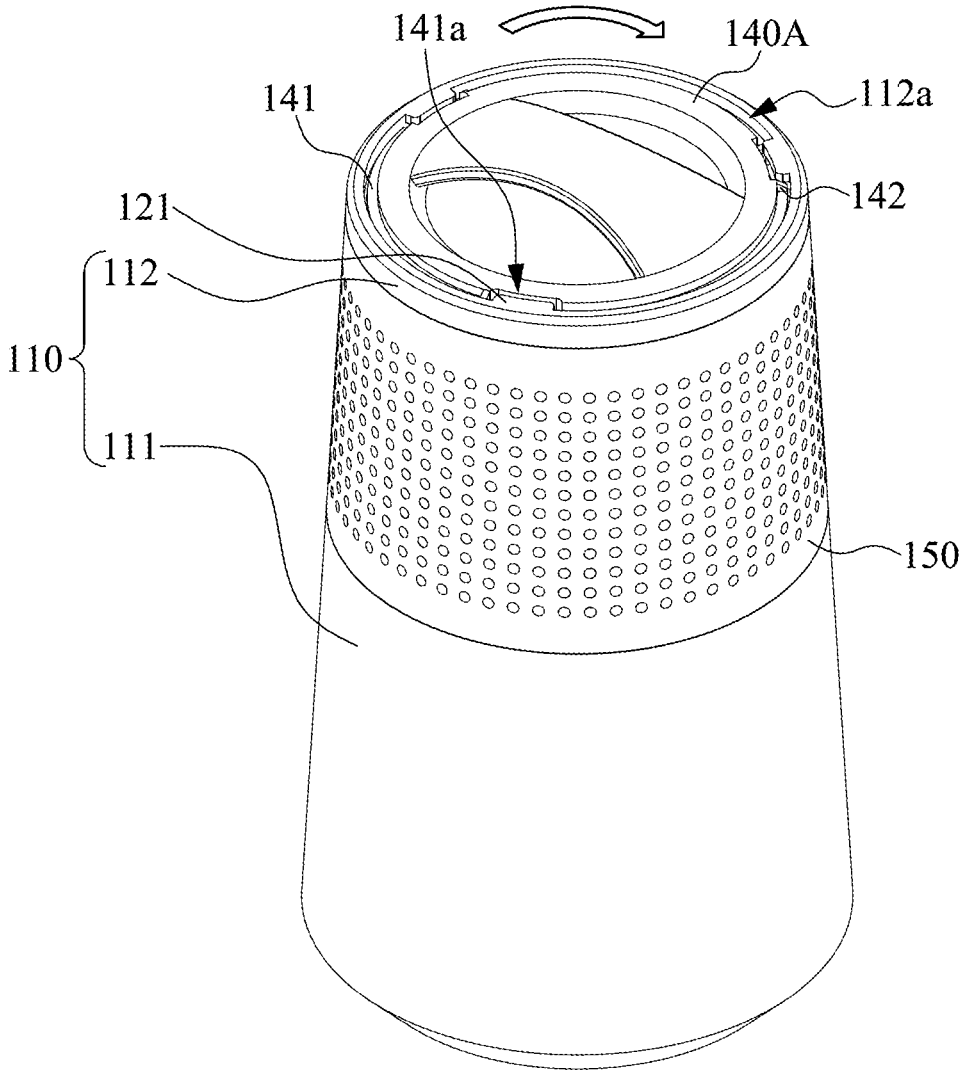
FIG. 1B is another perspective view of the speaker device in FIG. 1A, in which the sound guide structure covers an assembly opening of the housing.
Figure 1C:
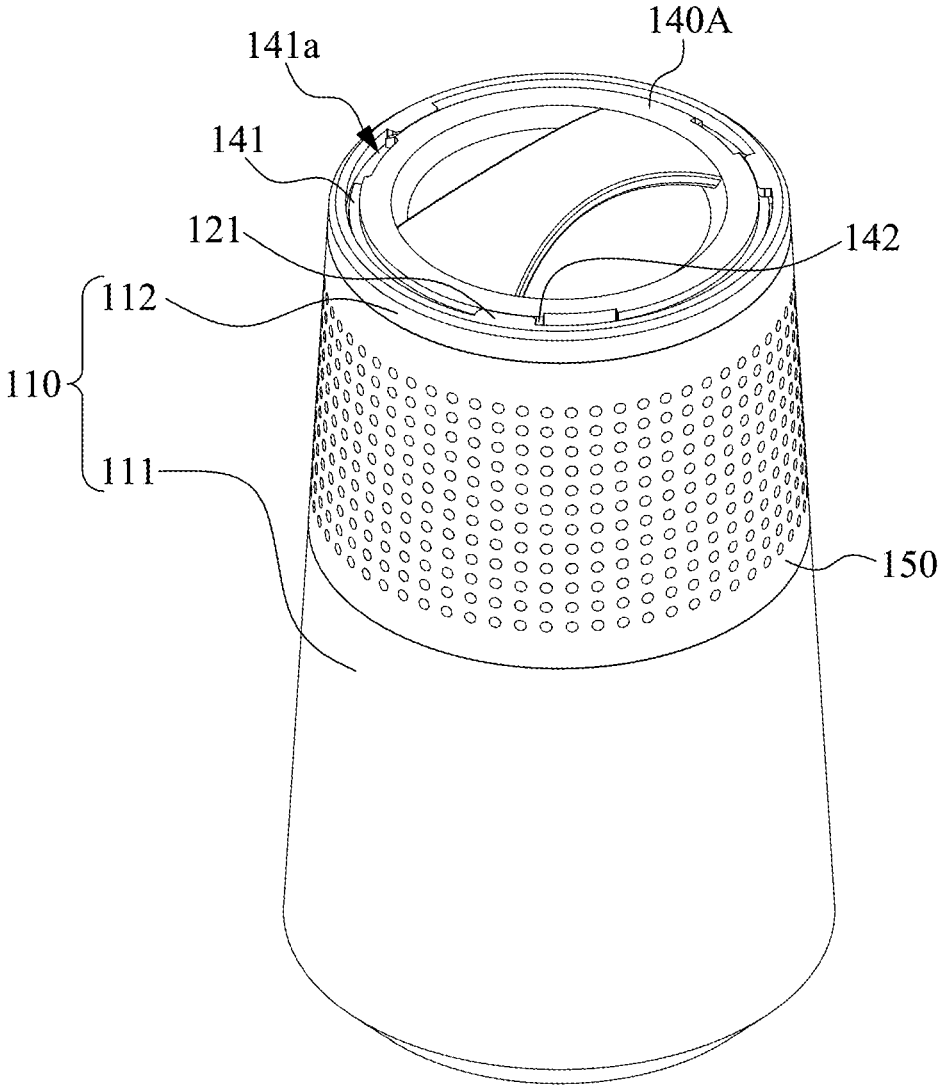
FIG. 1C is another perspective view of the speaker device in FIG. 1A, in which the housing is engaged with the sound guide structure.
Figure 2:
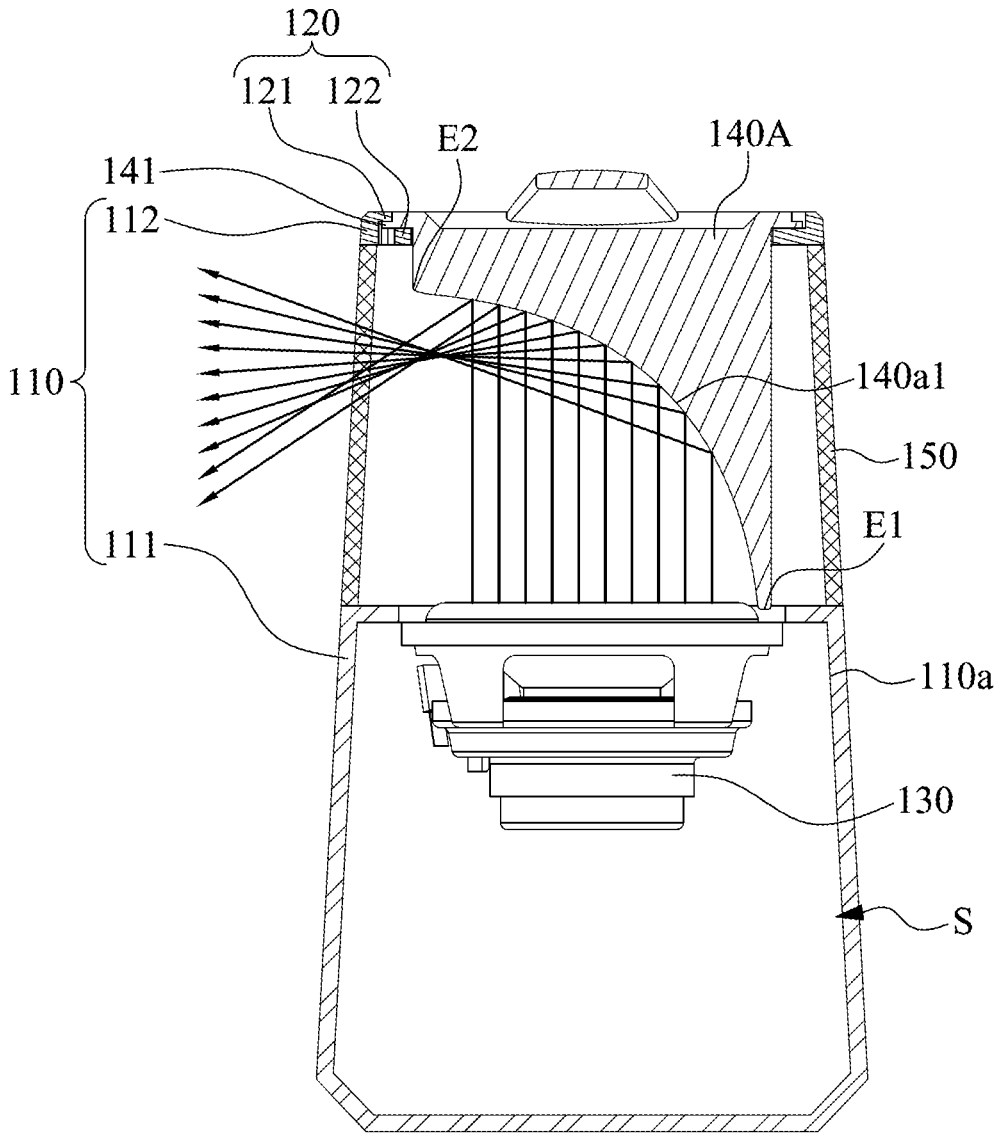
FIG. 2 is a side view of the speaker device in FIG. 1C, in which the housing is illustrated by a cross-section.

Reference is made to FIGS. 1A-2. FIG. 1A is a perspective view of a speaker device 100A according to some embodiments of the disclosure, in which a housing 110 is separated from a sound guide structure 140A. FIG. 1B is another perspective view of the speaker device 100A in FIG. 1A, in which the sound guide structure 140A covers an assembly opening 112*a* of the housing 110. FIG. 1C is another perspective view of the speaker device 100A in FIG. 1A, in which the housing 110 is engaged with the sound guide structure 140A. FIG. 2 is a side view of the speaker device 100A in FIG. 1C, in which the housing 110 is illustrated by a cross-section.

As shown in FIGS. 1A-2, in some embodiments, the speaker device 100A includes the housing 110, an engagement structure 120, a speaker unit 130, the sound guide structure 140A, and a mesh hood 150. The housing 110 has an accommodating space S. The engagement structure 120 is disposed on the housing 110. The sound guide structure 140A is detachably engaged with the engagement structure 120. The speaker unit 130 is located in the accommodating space S and configured to sound towards the sound guide structure 140A. The mesh hood 150 is disposed on the housing 110, and the accommodating space S of the housing 110 is communicated to the outside of the housing 110 via the mesh hood 150.

In some embodiments, the housing 110 has the assembly opening 112*a*. The assembly opening 112*a* is located at the top of the housing 110 and in spatial communication with the accommodating space S. The engagement structure 120 is disposed in the accommodating space S and adjacent to the assembly opening 112*a*. The sound guide structure 140A covers the assembly opening 112*a* of the housing 110 after being engaged with the engagement structure 120.

Specifically, the engagement structure 120 includes a first latch portion 121 and a supporting portion 122. The supporting portion 122 is far away from the assembly opening 112*a* than the first latch portion 121 (i.e., is closer to speaker unit 130 in the accommodating space S). The sound guide structure 140A has a second latch portion 141. The second latch portion 141 is located at an outer edge of the sound guide structure 140A and rotatably retained between the first latch portion 121 and the supporting portion 122.

In some embodiments, the supporting portion 122 of the engagement structure 120 is substantially ring-shaped and protrudes from an inner surface 110*a* of the housing 110. The second latch portion 141 of the sound guide structure 140A can be a ring-shaped structure or can be constituted by a plurality of arc structures.

In some embodiments, an inner diameter of the supporting portion 122 is smaller than an outer diameter of the second latch portion 141. As such, the sound guide structure 140A can be supported on the supporting portion 122 of the engagement structure 120 through the second latch portion 141, and the second latch portion 141 can slide on the supporting portion 122 while the sound guide structure 140A rotating relative to the assembly opening 112*a*.

In some embodiments, the first latch portion 121 of the engagement structure 120 is bump-like and inwardly protrudes from an inner edge of the assembly opening 112*a*. In order to allow the second latch portion 141 to be rotatably retained between the first latch portion 121 and the supporting portion 122, an inner diameter of the first latch portion 121 can be designed to be smaller than the outer diameter of the second latch portion 141.

In some embodiments, the second latch portion 141 has a notch 141*a* configured to allow the first latch portion 121 to pass through.

With the foregoing structural configurations, while assembling the sound guide structure 140A to the housing 110, the notch 141*a* of the second latch portion 141 can be aligned with the first latch portion 121 as shown in FIG. 1A. Then, the sound guide structure 140A is moved to cover the assembly opening 112*a* of the housing 110 as shown in FIG. 1B, and the first latch portion 121 will pass through the notch 141*a* of the second latch portion 141 in the meanwhile. Finally, the sound guide structure 140A is rotated relative to the assembly opening 112*a* as shown in FIG. 1C (the rotation direction is indicated by the large arrow in FIG. 1B), so as to make the second latch portion 141 be retained between the first latch portion 121 and the supporting portion 122. As such, the process of assembling the sound guide structure 140A to the housing 110 is finished, and the retaining of the first latch portion 121 to the second latch portion 141 can achieve the function of preventing the sound guide structure 140A from leaving the assembly opening 112*a*.

In some embodiments, the sound guide structure 140A further has a stopping portion 142. The stopping portion 142 is connected to the second latch portion 141, located at a side of the notch 141*a*, and configured to abut against the first latch portion 121. When the sound guide structure 140A rotates relative to the assembly opening 112*a* till the stopping portion 142 abuts against a side of the first latch portion 121, the first latch portion 121 is misaligned with the notch 141*a* of the second latch portion 141. As such, the sound guide structure 140A will not be excessively rotated relative to the assembly opening 112*a* to make the first latch portion 121 be aligned with the notch 141*a* of the second latch portion 141 again, so as to prevent the sound guide structure 140A from leaving the assembly opening 112*a* of the housing 110.

In some embodiments, as shown in FIG. 2, the housing 110 includes a first part 111 and a second part 112. The speaker unit 130 is disposed on the first part 111. The second part 112 is rotatably engaged with the first part 111 and forms the accommodating space S with the first part 111. The engagement structure 120 and the sound guide structure 140A are disposed on the second part 112. As such, in the embodiments that the sound guide structure 140A is a unidirectional sound guide plate, the purpose of adjusting the direction of sound can be achieved by making the first part 111 rotate relative to the second part 112.

In some embodiments, as shown in FIG. 2, the sound guide structure 140A is a unidirectional sound guide plate and has an arc surface 140*a*1. The arc surface 140*a*1 has two ends E1, E2 opposite to each other and respectively adjacent to the engagement structure 120 and the speaker unit 130. In detail, the sound guide structure 140A is gradually tapered from the top surface of the second part 112 to a side of the speaker unit 130 to form the arc surface 140*a*1. As such, sounds produced by the speaker unit 130 can be directed in a single direction (or in a concentrated direction range) by the arc surface 140*a*1 of the sound guide structure 140A and then leave the speaker device 100A via the mesh hood 150. In practical applications, the speaker device 100A of the present embodiment can be used as a personal computer (PC) speaker so that the sound is only exported to the user who is using the PC.

Figure 3:
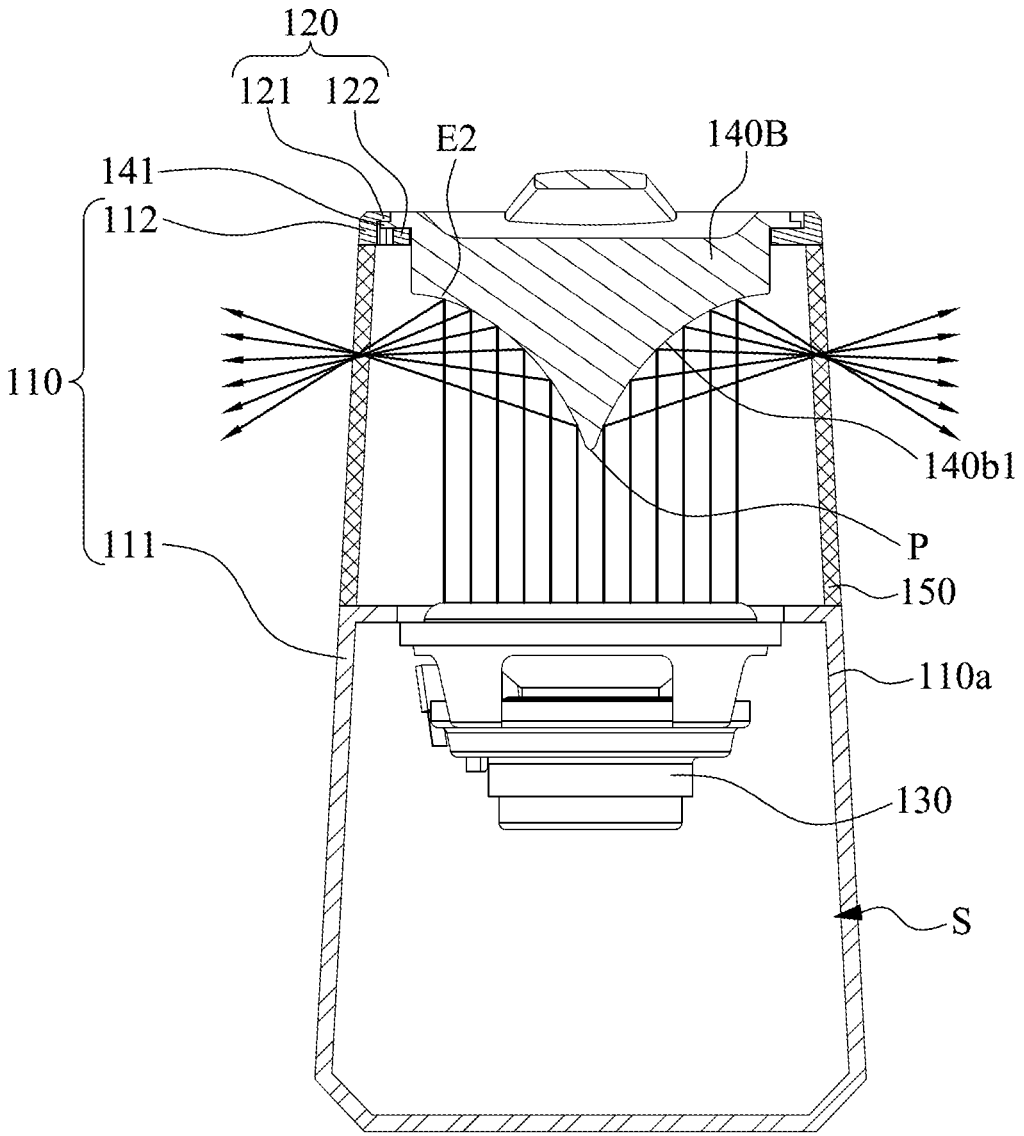
FIG. 3 is a side view of a speaker device according to some embodiments of the disclosure, in which the housing is illustrated by a cross-section.

However, the appearance of the sound guide structure 140A is not limited by the embodiment shown in FIG. 2. Reference is made to FIG. 3. FIG. 3 is a side view of a speaker device 100B according to some embodiments of the disclosure, in which the housing 110 is illustrated by a cross-section. As shown in FIG. 3, in some embodiments, a sound guide structure 140B is a multi-directional sound guide plate. Specifically, the sound guide structure 140B has a conical arc surface 140*b*1. The conical arc surface 140*b*1 has a vertex P. The sound guide structure 140B is gradually tapered from the top surface of the second part 112 to the center of the speaker unit 130. The vertex P is a portion of the sound guide structure 140B closest to the speaker unit 130. As such, sounds produced by the speaker unit 130 can be directed in several directions by the conical arc surface 140*b*1 of the sound guide structure 140B and then leave the speaker device 100B via the mesh hood 150. In the present embodiment, the conical arc surface 140*b*1 of the sound guide structure 140B can direct sounds coming from below to 360 degrees in horizontal directions, so the speaker device 100B can also be called non-directional sound guide plate. In practical applications, the speaker device 100B of the present embodiment can be used in a multi-person environment or in a center of an indoor space (e.g., a multiplayer party occasion).

Figure 4A:
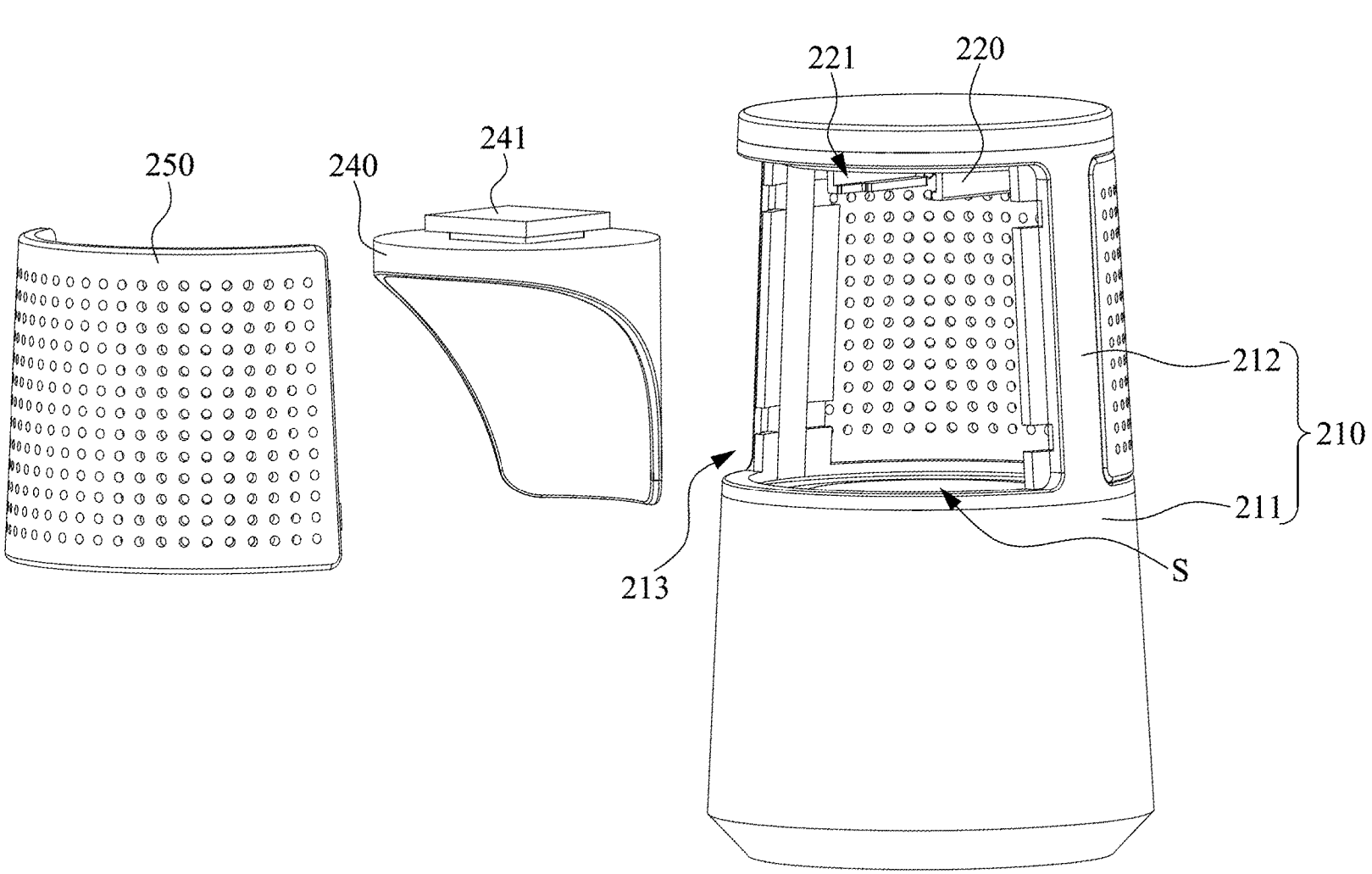
FIG. 4A is a perspective view of a speaker device according to some embodiments of the disclosure, in which a housing, a sound guide structure, and a mesh hood are separated from each other.
Figure 4B:
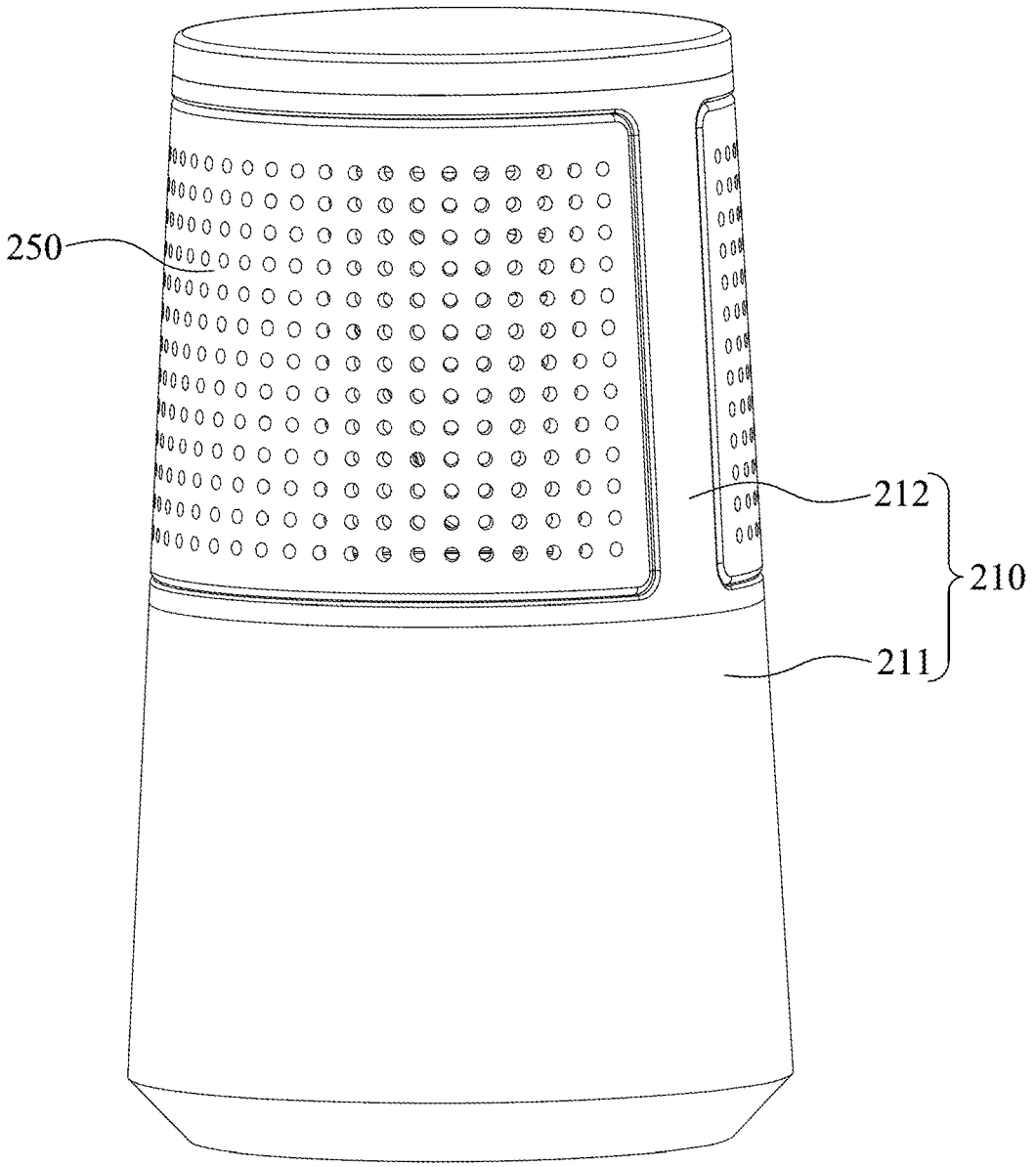
FIG. 4B is another perspective view of the speaker device in FIG. 4A, in which the speaker device is assembled.
Figure 5:
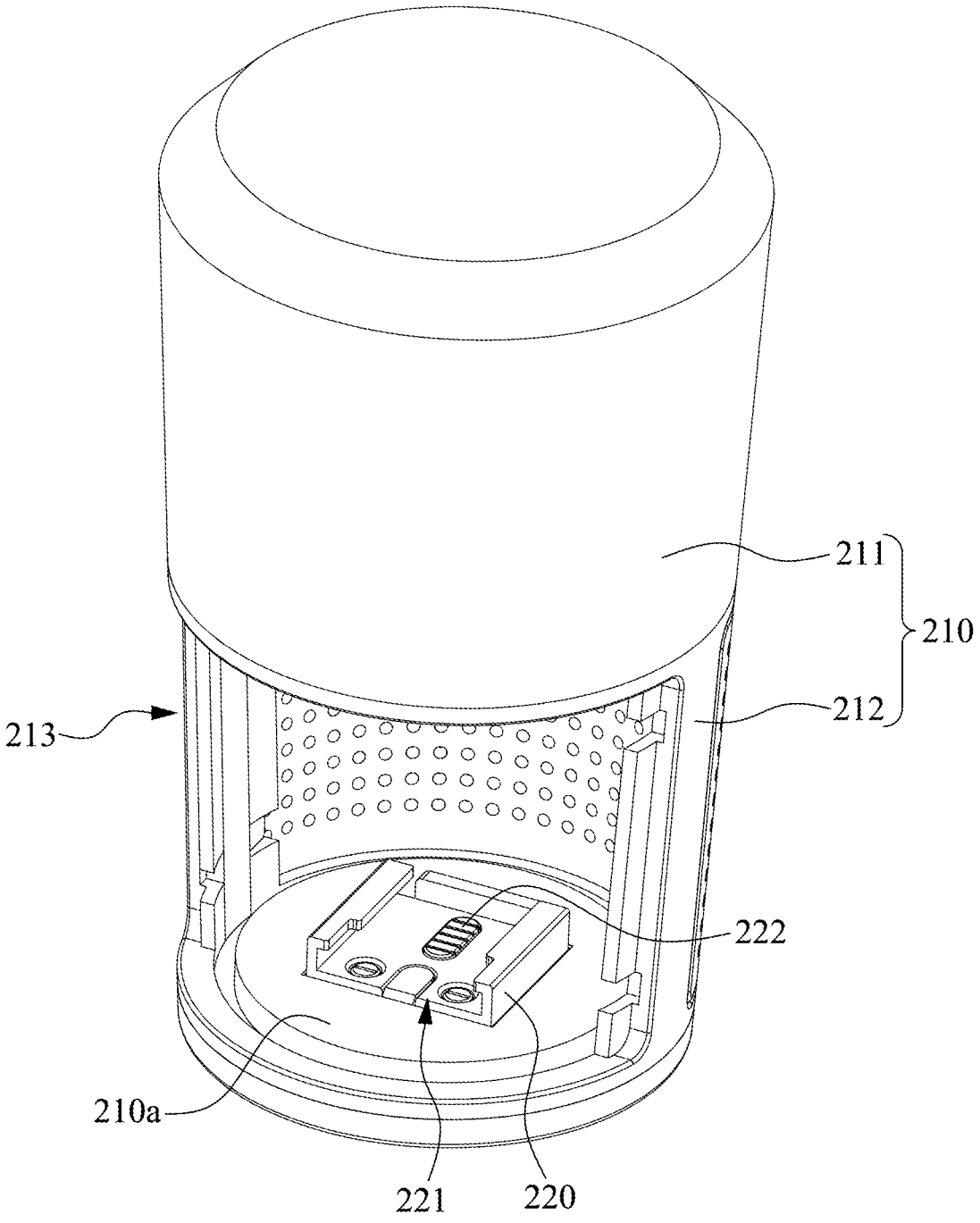
FIG. 5 is a partial perspective view of the speaker device in FIG. 4A.

Reference is made to FIGS. 4A-5. FIG. 4A is a perspective view of a speaker device 200 according to some embodiments of the disclosure, in which a housing 210, a sound guide structure 240, and a mesh hood 250 are separated from each other. FIG. 4B is another perspective view of the speaker device 200 in FIG. 4A, in which the speaker device 200 is assembled. FIG. 5 is a partial perspective view of the speaker device 200 in FIG. 4A.

As shown in FIGS. 4A-5, in some embodiments, the speaker device 200 includes the housing 210, an engagement structure 220, a speaker unit 130, the sound guide structure 240, and the mesh hood 250. The housing 210 has an accommodating space S. The engagement structure 220 is disposed on the housing 210. The sound guide structure 240 is detachably engaged with the engagement structure 220. The speaker unit 130 is located in the accommodating space S and configured to sound towards the sound guide structure 240. The mesh hood 250 is disposed on the housing 210, and the accommodating space S of the housing 210 is communicated to the outside of the housing 210 via the mesh hood 250.

Specifically, the housing 210 has an inner surface 210*a*. The engagement structure 220 is disposed on the inner surface 210*a* and has a sliding chute 221. The sound guide structure 240 has a sliding block 241 slidably engaged with the sliding chute 221. In addition, the housing 210 has a sound outlet 213. The mesh hood 250 is detachably engaged with the housing 210 and covers the sound outlet 213.

With the foregoing structural configurations, while assembling the sound guide structure 240 to the housing 210, the mesh hood 250 can be separated from the housing 210 as shown in FIG. 4A to expose the sound outlet 213. Then, the sound guide structure 240 is moved to enter the accommodating space S of the housing 210 via the sound outlet 213 to make the sliding block 241 completely slide into the sliding chute 221, so as to finish the assembling of the sound guide structure 240 to the engagement structure 220. Finally, the mesh hood 250 is assembled to the housing 210 to cover the sound outlet 213 as shown in FIG. 4B, so as to finish the process of assembling the sound guide structure 240 to the housing 210.

In some embodiments, the sound guide structure 240 shown in FIG. 4A has the arc surface 140*a*1 as shown in FIG. 2 and therefore is a unidirectional sound guide plate. In some other embodiments, the sound guide structure 240 shown in FIG. 4A has the conical arc surface 140*b*1 as shown in FIG. 3 and therefore is a multi-directional sound guide plate (or non-directional sound guide plate).

In some embodiments, the housing 210 includes a first part 211 and a second part 212. The approach of connecting the first part 211 and the second part 212 is the same as that of the embodiment shown in FIG. 2, so it can be referred to the above related description without repeating here again.

In some embodiments, magnetic members that can attract each other can be disposed on the housing 210 and the mesh hood 250 respectively, so as to achieve the purpose of quickly fastening the mesh hood 250 to the housing 210 and disassembling the mesh hood 250 from the housing 210.

In some embodiments, as shown in FIG. 5, the engagement structure 220 includes a cushioning member 222. The cushioning member 222 is disposed at a bottom surface of the sliding chute 221 and configured to abut against the sliding block 241 of the sound guide structure 240 after the sliding block 241 slide into the sliding chute 221, so as to make the sliding block 241 and the sliding chute 221 form an interference fit and prevent the sound guide structure 240 from shaking and loosening on the engagement structure 220. In the present embodiment, the cushioning member 222 can be made of rubber, but the disclosure is not limited in this regard.

Figure 6A:
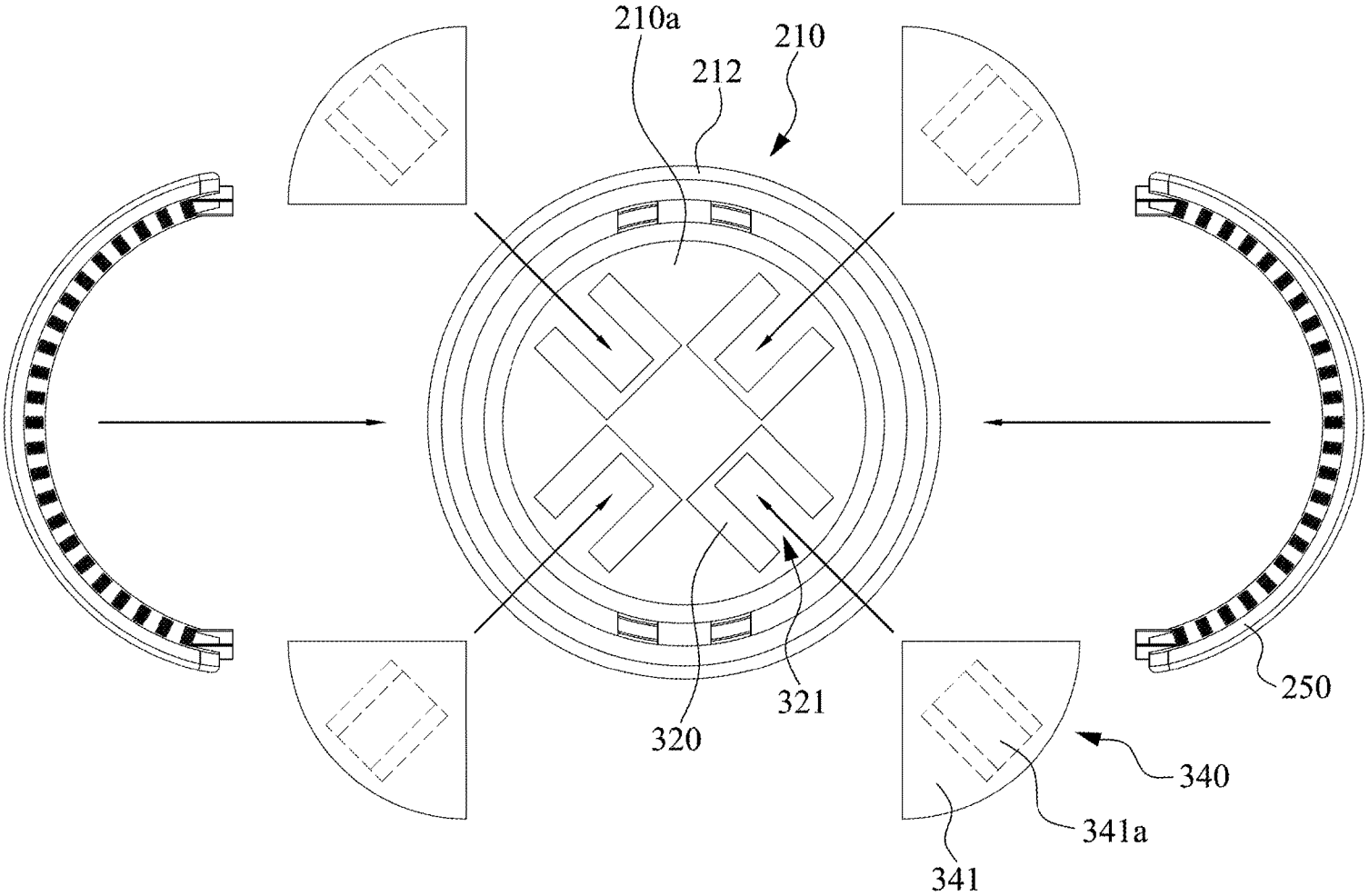
FIG. 6A is a bottom view of some components of a speaker device according to some embodiments of the disclosure, in which a sound guide structure is separated from an engagement structure.
Figure 6B:
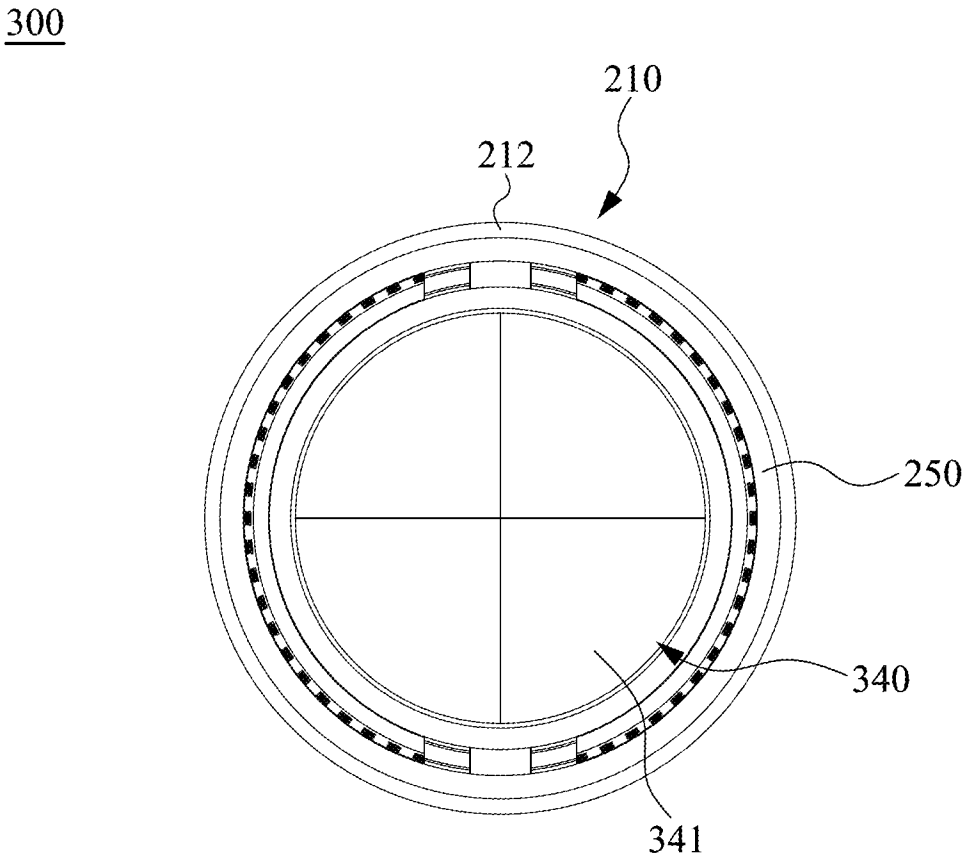
FIG. 6B is another bottom view of the structure in FIG. 6A, in which the sound guide structure is engaged with the engagement structure.

Reference is made to FIGS. 6A and 6B. FIG. 6A is a bottom view of some components of a speaker device 300 according to some embodiments of the disclosure, in which a sound guide structure 340 is separated from an engagement structure 320. FIG. 6B is another bottom view of the structure in FIG. 6A, in which the sound guide structure 340 is engaged with the engagement structure 320.

As shown in FIGS. 6A and 6B, in some embodiments, the speaker device 300 includes a housing 210, the engagement structure 320, a speaker unit 130, the sound guide structure 340, and a mesh hood 250, in which the housing 210, the speaker unit 130, and the mesh hood 250 are identical or similar to those of the embodiment shown in FIG. 4A, so they can be referred to the above related description without repeating here again. It should be pointed out that a difference between the present embodiment and the embodiment shown in FIG. 4A is that the engagement structure 320 has a plurality of sliding chutes 321 (only one of them is representatively labeled). In addition, the sound guide structure 340 includes a plurality of sound guide substructures 341 (only one of them is representatively labeled). The sound guide substructures 341 are capable of being separated from each other and each has a sliding block 341*a* (indicated by dotted lines and only one of them is representatively labeled). The sliding blocks 341*a* are slidably engaged with the sliding chutes 321, respectively.

In some embodiments, at least one of the sound guide substructures 341 can has the arc surface 140*a*1 as shown in FIG. 2. When there is only one sound guide substructure 341 having the arc surface 140*a*1 as shown in FIG. 2, the sound guide structure 340 is a unidirectional sound guide plate. When there are several sound guide substructures 341 each having the arc surface 140*a*1 as shown in FIG. 2, the sound guide structure 340 is a multi-directional sound guide plate. Alternatively, the arc surfaces 140*a*1 of the several sound guide substructures 341 can have different curvatures, so as to combine different sound fields, but the disclosure is not limited in this regard.

The embodiment shown in FIGS. 6A and 6B only illustrates four sets of combination of the engagement structure 320 and the sound guide substructure 341, but the disclosure is not limited in this regard and can be flexibly adjusted according to actual requirements.

In some embodiments, as shown in FIG. 6A, the sliding chutes 321 of the engagement structure 320 are substantially arranged in a radial manner, but the disclosure is not limited in this regard. In practical applications, the sliding chutes 321 of the engagement structure 320 can also be substantially parallel to each other.

According to the foregoing recitations of the embodiments of the disclosure, it can be seen that in the speaker device of the present disclosure, the speaker unit is placed up right, so the bottom area of the housing can be smaller than traditional speaker devices. In addition, the sound guide structure adopted in the present disclosure can be one of the unidirectional sound guide plate and a multi-directional sound guide plate, and can be detachably engaged with the engagement structure disposed on the housing. As a result, a user can replace different sound guide structures according to requirements to produce sounds with different sound fields.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A speaker device, comprising:
- a housing having an accommodating space, wherein the housing has an assembly opening in spatial communication with the accommodating space;
- an engagement structure disposed on the housing, in the accommodating space, and adjacent to the assembly opening;
- a sound guide structure detachably engaged with the engagement structure and covering the assembly opening; and
- a speaker unit located in the accommodating space and configured to sound towards the sound guide structure.

2. The speaker device of claim 1, wherein the sound guide structure is one of a unidirectional sound guide plate and a multi-directional sound guide plate.

3. The speaker device of claim 1, wherein the engagement structure comprises a first latch portion and a supporting portion, the supporting portion is far away from the assembly opening than the first latch portion, the sound guide structure has a second latch portion, and the second latch portion is located at an outer edge of the sound guide structure and rotatably retained between the first latch portion and the supporting portion.

4. The speaker device of claim 3, wherein the second latch portion has a notch configured to allow the first latch portion to pass through.

5. The speaker device of claim 3, wherein the sound guide structure further has a stopping portion, and the stopping portion is connected to the second latch portion and configured to abut against the first latch portion.

6. The speaker device of claim 1, wherein the housing has a sound outlet, the speaker device further comprises a mesh hood, and the mesh hood is detachably engaged with the housing and covers the sound outlet.

7. The speaker device of claim 1, wherein the sound guide structure is a unidirectional sound guide plate and has an arc surface, and the arc surface has two ends opposite to each other and respectively adjacent to the engagement structure and the speaker unit.

8. The speaker device of claim 1, wherein the sound guide structure is a multi-directional sound guide plate and has a conical arc surface, the conical arc surface has a vertex, and the vertex is a portion of the sound guide structure closest to the speaker unit.

9. A speaker device, comprising:
- a housing having an accommodating space, wherein the housing has an inner surface;
- an engagement structure disposed on the inner surface and having a sliding chute;
- a sound guide structure detachably engaged with the engagement structure and having a sliding block slidably engaged with the sliding chute; and
- a speaker unit located in the accommodating space and configured to sound towards the sound guide structure.

10. A speaker device, comprising:
- a housing having an accommodating space, wherein the housing comprises:

a first part; and a second part rotatably engaged with the first part and forming the accommodating space with the first part;

an engagement structure disposed on the second part;

a sound guide structure disposed on the second part and detachably engaged with the engagement structure; and a speaker unit located disposed on the first part, in the accommodating space, and configured to sound towards the sound guide structure.

11. A speaker device, comprising:

a housing having an accommodating space;

an engagement structure disposed on the housing;

a sound guide structure detachably engaged with the engagement structure, wherein the sound guide structure comprises a plurality of sound guide substructures, and the sound guide substructures are capable of being separated from each other and individually engaged with the engagement structure; and a speaker unit located in the accommodating space and configured to sound towards the sound guide structure.

12. The speaker device of claim 11, wherein the housing has an inner surface, the engagement structure is disposed on the inner surface and has a plurality of sliding chutes, each of the sound guide substructures has a sliding block, and the sliding blocks are slidably engaged with the sliding chutes, respectively.

13. The speaker device of claim 12, wherein the sliding chutes are substantially arranged in a radial manner.

* * * * *